US006449376B1

(12) United States Patent
Beltran et al.

(10) Patent No.: US 6,449,376 B1
(45) Date of Patent: Sep. 10, 2002

(54) PLANAR-TYPE LOUDSPEAKER WITH AT LEAST TWO DIAPHRAGMS

(75) Inventors: Carlos Beltran, Beverly; Lewis Athanas, Newbury; David Cahill, Merrimac; Wako Iwasaki, Brookline; Andrew Kotsatos, Arlington, all of MA (US)

(73) Assignee: Boston Acoustics, Inc., Peabody, MA (US)

( * ) Notice: Subject to any disclaimer, the term of this patent is extended or adjusted under 35 U.S.C. 154(b) by 0 days.

(21) Appl. No.: 09/399,536

(22) Filed: Sep. 20, 1999

(Under 37 CFR 1.47)

(51) Int. Cl.[7] ..... H04R 25/00
(52) U.S. Cl. ..... 381/423; 381/424
(58) Field of Search ..... 381/150, 423, 381/424, 431, 420; 181/144, 163–164, 157

(56) References Cited

U.S. PATENT DOCUMENTS 4,829,581 A * 5/1989 Nieuwendijk et al. ..... 381/424
4,847,908 A * 7/1989 Nieuwendijk et al. ..... 381/424
5,539,835 A 7/1996 Bertagni et al.
5,615,275 A 3/1997 Bertagni

FOREIGN PATENT DOCUMENTS

| | | | |
|---|---|---|---|
| EP | 0 262 406 | | 4/1988 |
| JP | 58133098 | * | 8/1983 |
| JP | 58157296 | * | 9/1983 |

* cited by examiner

*Primary Examiner*—Curtis Kuntz
*Assistant Examiner*—P. Dabney
(74) *Attorney, Agent, or Firm*—Wolf, Greenfield & Sacks, P.C.

(57) ABSTRACT

A planar-type loudspeaker is provided which includes at least two separate, substantially flat, substantially coplanar diaphragms driven by a common drive mechanism. The diaphragms are each of a material and are dimensioned so that each has only a limited number of natural modes of vibration in the frequency band in which it is to operate and that corresponding natural modes for the diaphragms are close enough to achieve beneficial mechanical coupling and acoustics interference so as to provide a generally uniform acoustic pressure response over the selected frequency band. The diaphragms are preferably coupled only through the drive mechanism and it is preferable that each diaphragm have only two natural modes of vibration in the selected frequency band.

11 Claims, 5 Drawing Sheets

PLANAR-TYPE LOUDSPEAKER WITH AT LEAST TWO DIAPHRAGMS

FIELD OF THE INVENTION

This invention relates to loudspeakers and more particularly to planar-type loudspeakers adapted to operate over a significant frequency range while still providing a substantially uniform pressure response and efficiency comparable to that of conventional loudspeakers.

BACKGROUND OF THE INVENTION

Speakers are frequently mounted in a door panel, wall, ceiling or the like of a mobile conveyance (for example, an automobile, boat, or trailer), a home, or various commercial environments where the available space for the speaker is relatively narrow and conventional speakers cannot fit into such space without some esthetically undesirable projection of the speaker into the listening area. A class of speakers referred to as planar-type or flat panel speakers have been developed for such applications. These speakers generally involve one or more voice coil drive mechanisms connected to drive one or more diaphragms. While for speakers operating over a relatively narrow frequency range, a single diaphragm driven by a single voice coil can be utilized, for speakers intended to operate over a wider frequency range, two or more diaphragms may be required, which may be driven from a common voice coil, but are frequently driven by separate voice coils.

While these flat panel loudspeakers are ideally suited for applications where there is little depth available for mounting the speaker, these speakers also suffer from a number of limitations which has severally restricted their use. A principle disadvantage is that the acoustic pressure response of these speakers is significantly less uniform than that for conventional speakers, especially at higher frequencies. In theory, the fact that each diaphragm has a large number, possibly even thousands, of natural vibration modes in the frequency range of interest should provide a relatively uniform frequency response due to the substantially random behavior of the diaphragm; however, this has not turned out to be the case in practice. Recent attempts to optimize these speakers to achieve a more uniform response, including controlling the shape of the diaphragms and the position at which a voice coil is attached to each diaphragm, have not resulted in significant improvement, the acoustic pressure response for these speakers still being substantially less uniform than for conventional speakers. Another problem with the planar-type loudspeakers is that they have a relatively low efficiency compared to conventional speakers. Finally, while in theory these speakers should be relatively inexpensive to manufacture, various techniques which have been employed in the prior art in an effort to enhance the pressure response uniformity of these speakers has increased their cost so that such speakers are now generally significantly more expensive than comparable conventional speakers.

A need therefore exists for a planar or flat panel speaker which is capable of providing a substantially uniform acoustic pressure response, at least comparable to that of comparable conventional speakers, over a reasonably wide frequency band, including higher frequencies, while having an operating efficiency which is at least comparable to that of conventional loudspeakers and a manufacturing cost which is no greater than that for a comparable conventional loudspeaker, and preferably cheaper.

SUMMARY OF THE INVENTION

In accordance with the above, this invention provides a planar-type loudspeaker for operation in a selected frequency band. The loudspeaker includes at least two separate, substantially flat, substantially co-planar diaphragms and a common drive mechanism for the diaphragms. The diaphragms are each of a material and are dimensioned so that each has only a limited number of natural modes of vibration in the selected frequency band and that corresponding natural modes for the diaphragms are close enough to achieve beneficial mechanical coupling and acoustic interference so as to provide a generally uniform acoustic pressure response over the selected frequency band. The diaphragms are preferably coupled only through the drive mechanism. It is also preferable that there be only two natural modes of vibration in the selected frequency band.

For preferred embodiments, there are two co-axial, substantially circular diaphragms, an inner diaphragm and an outer diaphragm, with the drive mechanism being connected to both diaphragms. For preferred embodiments, the inner diaphragm has first and second natural modes $F1_{in}$ and $F2_{in}$ respectively, the outer diaphragm has first and second natural modes $F1_{out}$ and $F2_{out}$ respectively, $F1_{out}/F1_{in} \approx 0.4$ to 2.1 and $F2_{out}/F2_{in} \approx 0.5$ to 2.0. For all embodiments, extra material may be applied to at least one of the diaphragms to alter at least one of its natural modes in a predetermined way. For the preferred embodiments discussed earlier, the extra material is a piece of material having good damping properties which is attached at least near the center of the inner diaphragm. Similarly, the loudspeaker may include an outer frame with at least one of the diaphragms being adjacent to the frame and connected to the frame through a compliant surround, it being the outer diaphragm which is attached to the frame through the compliant surround for preferred embodiments,.

The foregoing and other objects, features and advantages of the invention will be apparent from the following more particular description of a preferred embodiment of the invention as illustrated in the accompanying drawings.

DRAWINGS

DETAILED DESCRIPTION

Figure 1:
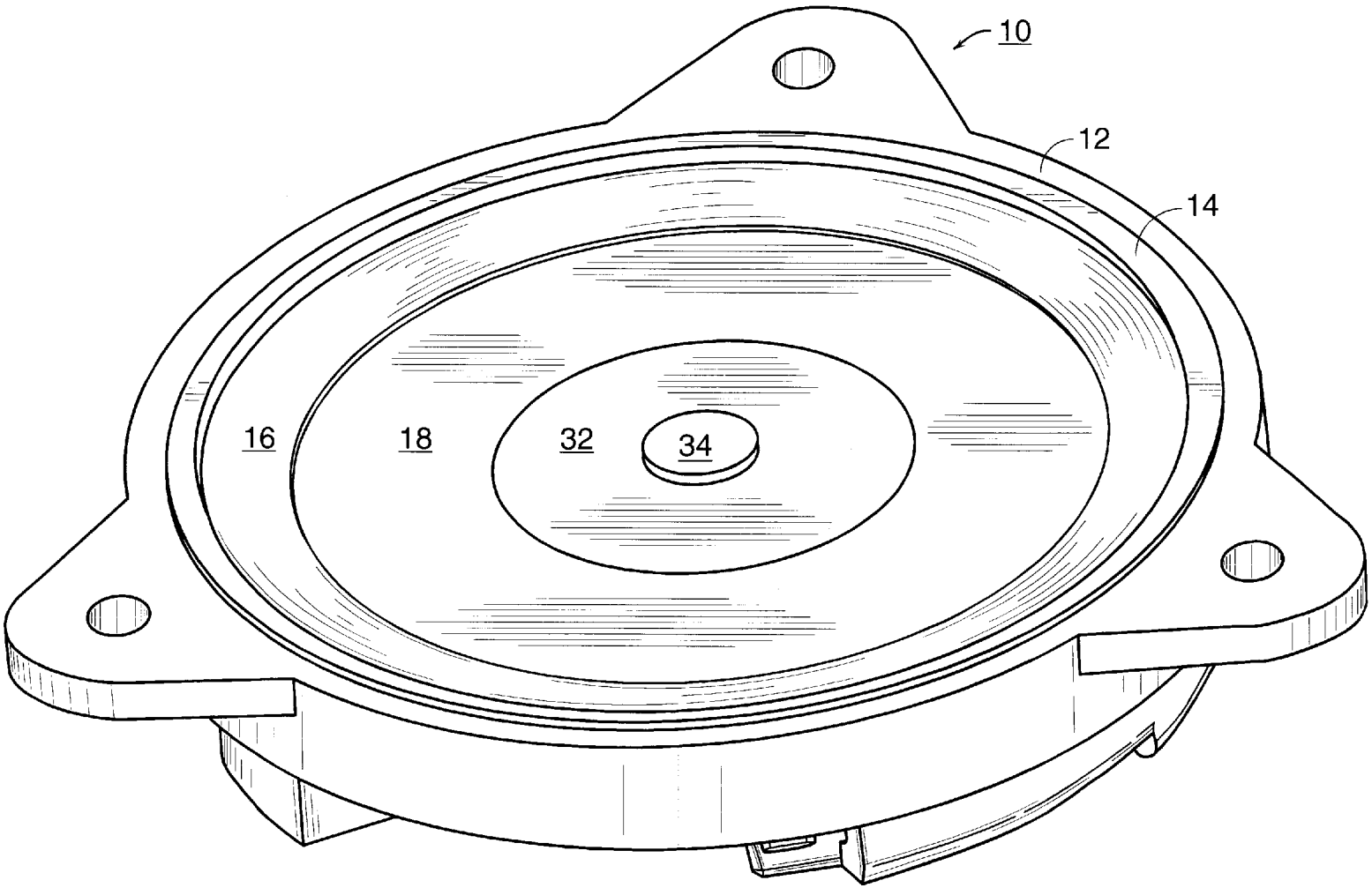
FIG. 1 is a top perspective view of a planar-type loudspeaker in accordance with an illustrative embodiment of the invention.
Figure 2:
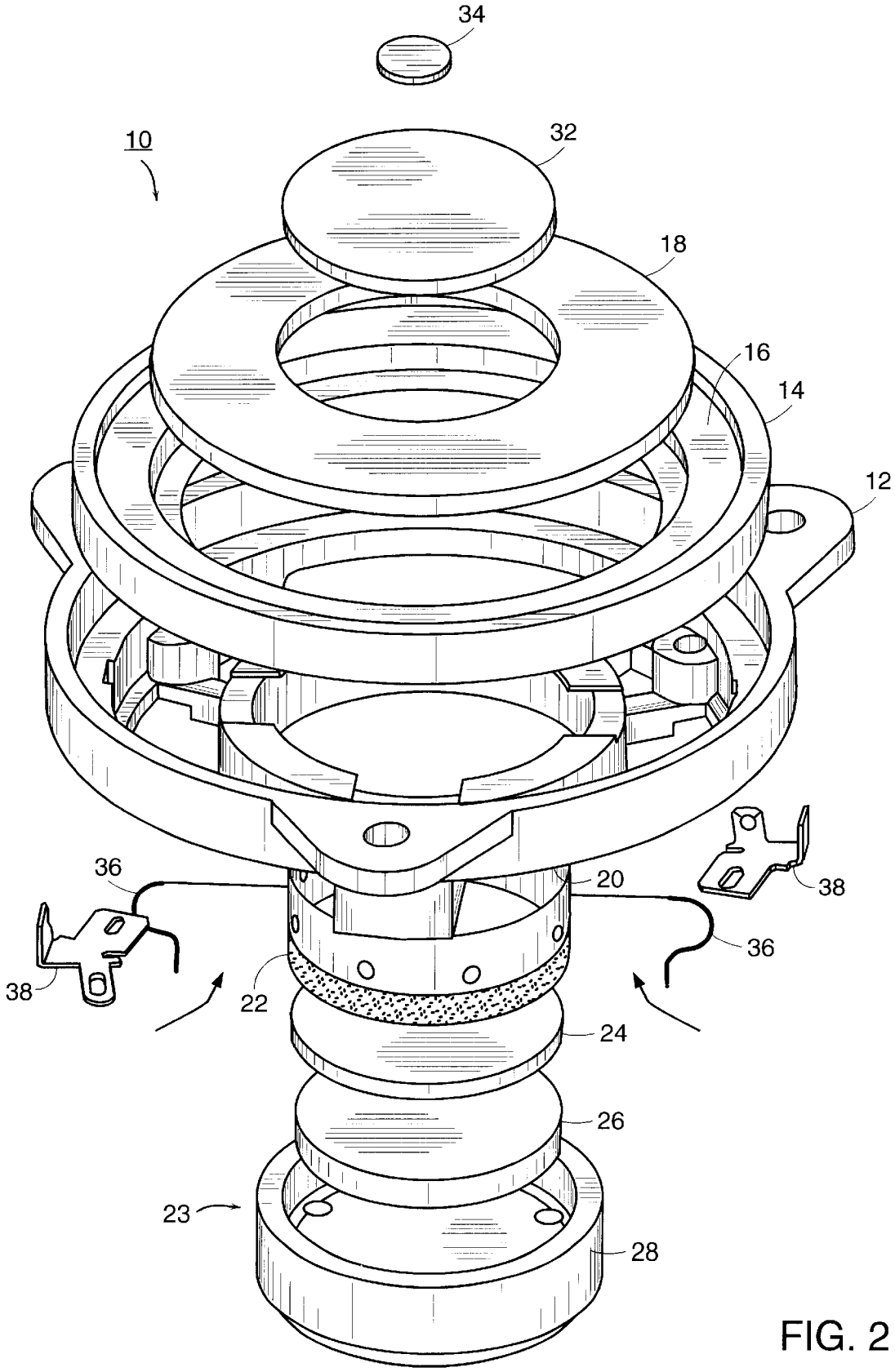
FIG. 2 is an exploded view of the speaker shown in FIG. 1.
Figure 3:
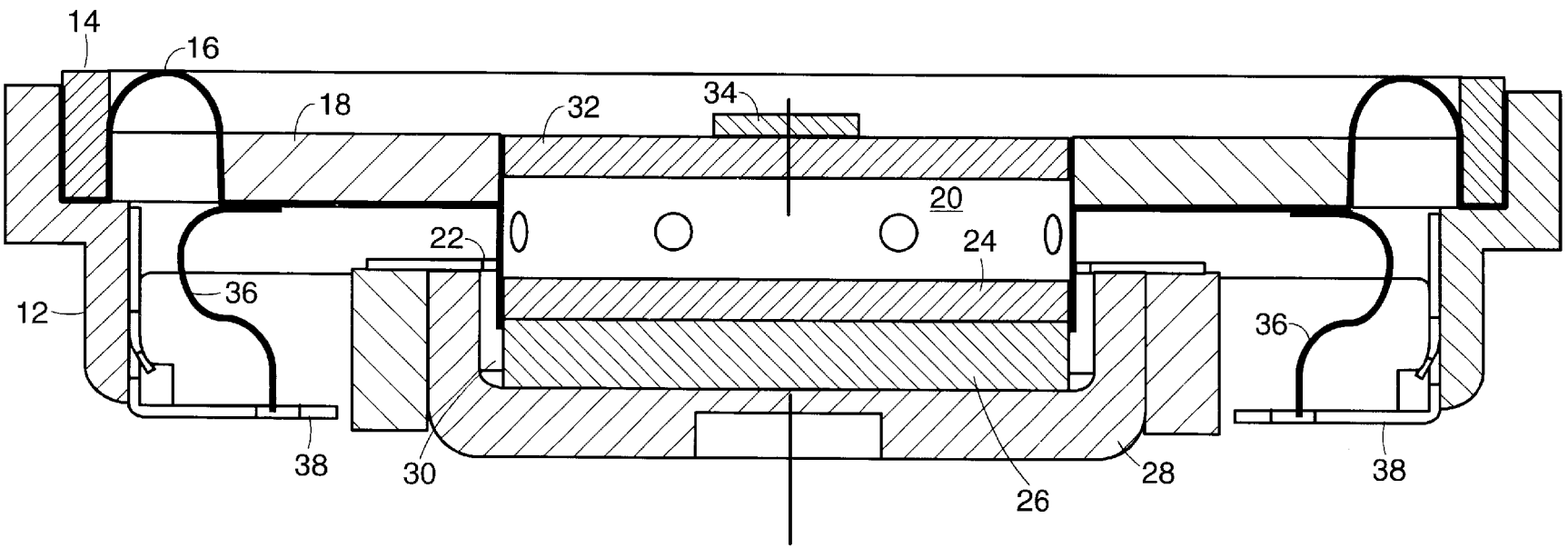
FIG. 3 is a sectional view of the speaker shown in FIG. 1.

Referring to FIGS. 1–3, a flat panel speaker 10 is shown which includes a support frame 12 attached through a gasket 14 and a compliant surround 16 to an outer diaphragm 18 of the flat panel speaker. The inner edge of diaphragm 18 is connected to the outside of a voice coil follower 20 having a voice coil 22 wrapped thereon in standard fashion. Voice coil follower 20 and voice coil 22 are part of the speaker drive mechanism 23 which also includes a top plate 24, magnet 26 and a pot or base 28. Plate 24 and pot 28 are both high magnetic permeability parts. The speaker drive mechanism is assembled as best seen in FIG. 3 in standard fashion, with the voice coil being in a voice coil gap 30 formed between pot 28 on one side and top plate 24/magnet 26 on the other side. An inner diaphragm 32 is connected to the inside of voice coil follower 20 and a disk 34 of a material such as rubber having good damping properties is connected at substantially the center of diaphragm 32.

As may be best seen in FIG. 3, surround 16 preferably has a radius such that diaphragms 18 and 32 and voice coil 22 can move more freely at lower frequencies. Outer diaphragm 18 is preferably connected to surround 16 using an adhesive with high mechanical loss characteristics to enhance damping of the outer diaphragm, and in particular the primary or first significant natural mode of vibration thereof. The ends or leads from the voice coil are attached along the underside of outer diaphragm 18 to fine woven tinsel leads 36, the tinsel leads being attached to electrical output terminals 38 mounted to frame 12. Tinsel leads 36 function to provide strain relief for movement of the voice coil, and thus of diaphragms 18 and 32, relatively to the stationary terminals 38 to which the voice coil leads are attached.

In operation, audio signals are applied to voice coil 22, the voice coil interacting in standard fashion with the magnetic flux in gap 30 to cause the coil to move up and down in the gap. Coil follower 20 moves with voice coil 22. Since diaphragms 18 and 32 are fixed at their inner edge and outer edge respectively to the coil follower, they move with the coil follower to provide the desired audio output by moving air ahead of the diaphragms.

In accordance with the teachings of this invention, several things have been found to be critical in order to achieve a substantially uniform acoustic pressure response from the speaker. First, it is important that the diaphragms be separate and that each be driven by the common drive mechanism 23. This is different from many prior art planar-type speakers where, for example, one of the diaphragms is driven and the other diaphragm(s) compliantly coupled thereto, or where a separate drive mechanism, including voice coil, is provided for each diaphragm. It has also been found to be preferable that the diaphragms only be coupled to each other through the drive mechanism, diaphragms 18 and 32 for example only being connected through follower 20; however, this is not an essential limitation on the invention.

It is also important in achieving a uniform response from the speaker that the material for each diaphragm and the dimensions of the diaphragm be selected so that each diaphragm has only a limited number of natural modes of vibration in the frequency band over which the speaker is to be operated, preferably only two natural modes of vibration in this band, and that the corresponding natural modes of the diaphragms be close enough to each other to achieve beneficial mechanical coupling and acoustic interference sufficient to provide the desired response. It is preferred that variations in the acoustic response be within ±1 to 2 db when taken as averages over ⅕ to ⅓ octave. Variations in the response up to ±5 db taken in the same fashion may be reasonably assumed to be reducible to variations of ±1 to 2 db by suitable damping. If a speaker of the type shown in FIGS. 1–3 has two natural modes of vibration for each diaphragm in the frequency range of interest, the natural modes for outer diaphragm 18 being $F1_{out}$ and $F2_{out}$, and the natural modes for inner diaphragm 32 being $F1_{in}$ and $F2_{in}$, then in order to achieve a pressure response for the speaker with variations which do not exceed ±5 db before the use of damping materials, the speaker should be designed such that $F1_{out}/F1_{in} \approx 0.4$ to 2.1 and $F2_{out}/F2_{in} \approx 0.5$ to 2.0. Generally, it is desirable that these two ratios be as close to one as possible. However, it has been found that even if the diaphragms are designed so that the first natural mode and/or the second natural mode are equal, the diaphragms will not vibrate at the same frequency, the mechanical coupling of the diaphragms not permitting this to happen. Instead, one of the diaphragms, normally the inner diaphragm, will have a single clearly defined mode close in frequency to its mode in the uncoupled state, and the other diaphragm will have two modes, one above and one below the mode frequency in the uncoupled state, which modes have different time domain or phase behavior. Thus, these modes are able to provide the desired beneficial mechanical coupling and acoustic interference necessary to achieve a generally uniform acoustic pressure response over the selected frequency band.

The speaker designer has a number of parameters to deal with in designing diaphragms 18 and 32, including the material of the diaphragm, the thickness of each diaphragm, and the diameters of each diaphragm. Critical parameters for the diaphragm material include hardness/Young's modulus, density and mechanical damping. As with other loudspeakers, materials exhibiting high damping, high stiffness and low density are preferred. Density is of special importance because increased weight in the diaphragms adversely affects speaker efficiency. The outer diameter of the speaker is typically determined by the desired low frequency range for the speaker. Standard finite element analysis software may then be utilized to select the other parameters in order to achieve the desired response. For an illustrative embodiment, the diaphragms are formed from a polymethacrylimide rigid foam. For the inner diaphragm 32, this foam has a density of 52 kg/m$^2$, a modulus of elasticity of 70 N/mm$^2$ and a mechanical damping $\Lambda$ of 0.01. For the outer diaphragm 18, the foam has a density of 75 kg/m$^2$, a modulus of elasticity of 92 N/MM$^2$ and a mechanical damping $\Lambda$ of 0.01. For a frequency response of roughly 200 Hz to 18,000 Hz, the outer diaphragm 18 has an outer diameter of 49.5 mm, an inner diameter of 25.95 mm, and a thickness of 3.0 mm; while the inner diaphragm has an outer diameter of 25.84 mm and a thickness of 1.5 mm.

Disk 34 adds weight to the inner diaphragm in a location such that the frequency of the first natural mode is substantially reduced, while the frequency of the second mode is substantially unaffected. Disk 34 also adds a substantial amount of damping, to primarily the second mode frequency, significantly improving uniformity at the higher frequencies of the speakers operating band. However, since added weight for the diaphragms reduces efficiency of the speaker, the weight for disk 34 should generally be no greater than that of the inner diaphragm, and preferably less. In some applications, disk 34 may not be required. The disk also functions to control spacing between modes for the inner diaphragm. While the disk 34 for the illustrative embodiment is located at substantially the center of the inner diaphragm, this is not a limitation on the invention, and in suitable applications, a disk or other suitable piece of damping material could be placed on either one or both diaphragms and positioned to achieve desired damping and other effects.

The adhesives used for securing the diaphragms to voice coil follower 20 and for securing outer diaphragm 18 to surround 16 and, to a lesser extent, for securing surround 16 to gasket 14 are all of a type which provide damping. Compliant surround 16 also adds damping and reduces reflections.

Figure 4:
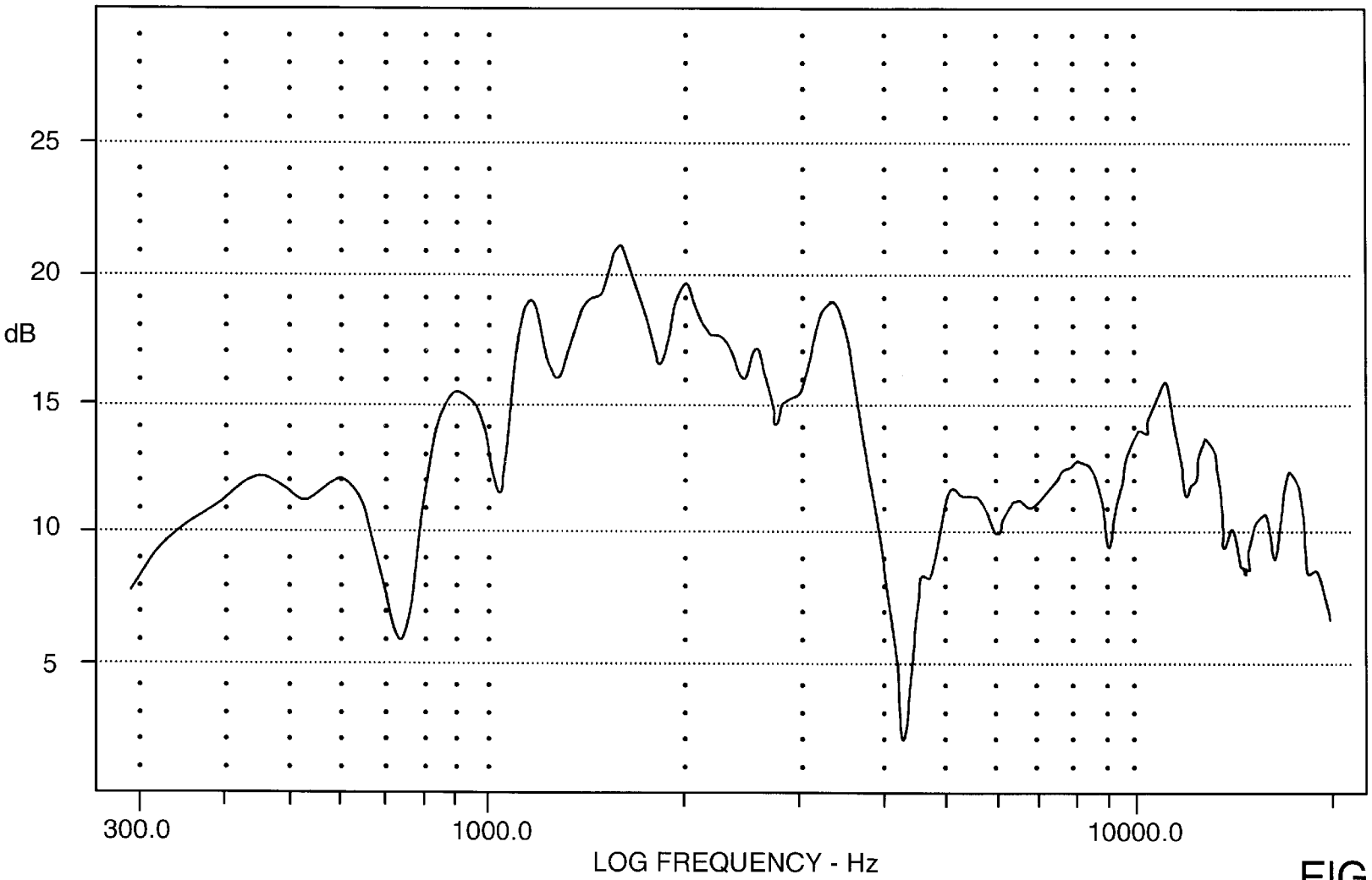
FIG. 4 is a graphical representation of the acoustic pressure response for an illustrative prior art planar-type loudspeaker.
Figure 5:
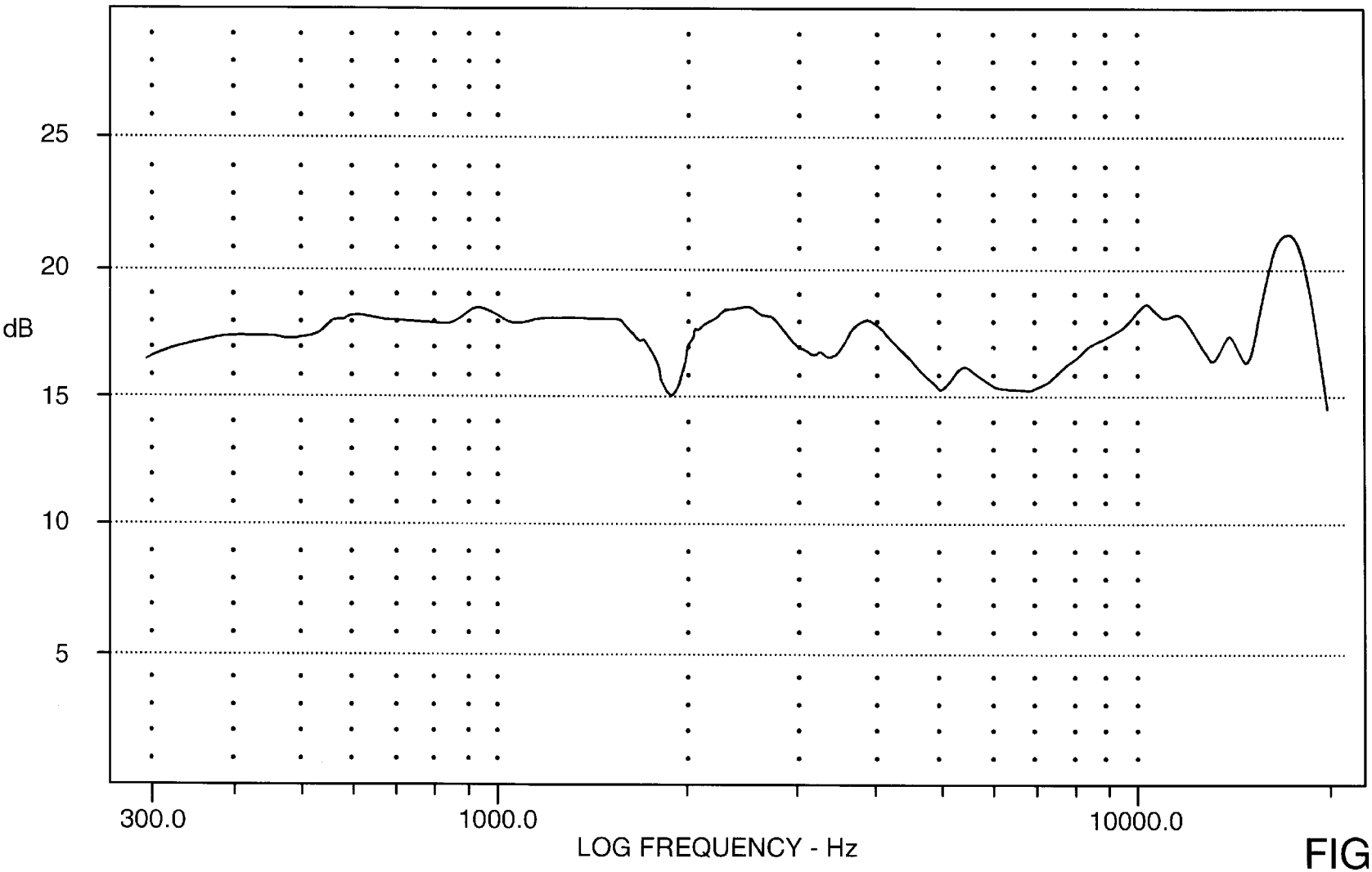
FIG. 5 is a graphical representation of the acoustic pressure response for the loudspeaker of FIG. 1 constructed in accordance with the teachings of this invention.

As evidence of the kind of response improvement which can be achieved utilizing the teachings of this invention, FIG. 4 illustrates an exemplary acoustic pressure response for a prior art planar-type speaker operating in the frequency band of the illustrative embodiment and FIG. 5 illustrates the acoustic pressure response for the speaker of the illustrative embodiment. From these figures it can be seen that while the prior art speaker has response variations of almost 20 db in the frequency band of interest, the variation for the speaker of the illustrative embodiment is in the range of ≈4 db. This improvement is achieved while also achieving enhanced efficiency and a speaker which is less expensive to produce.

While for the preferred embodiment discussed above, two diaphragms of a concentric circular shape are utilized, this is not a limitation on the invention, and many variations are possible while still remaining within the teachings of the invention. For example, with a circular inner diaphragm, the outer diaphragm could be oval, square or have some other shape known in the speaker industry. The shape of the inner diaphragm could also be square, oval or the like, either with a correspondingly-shaped outer diaphragm or with an outer diaphragm having a different shape. Further, while only two diaphragms are shown for the preferred embodiment, particularly for larger bass speakers, three or more diaphragms may be required, all of which would continue to be driven from a common source. The diaphragms also need not be divided so as to be concentric and, in particular, one or more of the layers of diaphragm could be split, typically the outer layer, the split for example being radial, to provide several separate diaphragms driven from a common source. Other variations in the size and shape of the diaphragms are also possible.

Likewise, while the diaphragms 18, 32 for the illustrative embodiment are connected to the outside and inside respectively of coil follower 20, this is also not a limitation on the invention so long as all diaphragms are connected to the follower or to otherwise move therewith. A diaphragm may for example be connected to the top, bottom, either side and/or some extension of the follower.

Similarly, while the thickness of the outer diaphragm has been shown as greater than that of the inner diaphragm for the illustrative embodiment, and this would typically be the case, the thickness of the diaphragms will vary substantially with application and the thickness of a diaphragm need not be uniform over its entire width. For example, one or more of the diaphragms shown in FIG. 3 might have a wedge-shaped cross-section, the thickness increasing with distance from the center of the speaker. While these variations in thickness may provide some performance advantages, such variations add to the cost of manufacture and are therefore not currently preferred.

Finally, while for the preferred embodiment, the diaphragms are axi-symmetric and the drive to the speakers is centered, these are also not limitations on the invention, and the diaphragms need not be either axi-symmetric or driven in a symmetric manner. Again, these variations change frequencies and mode spacing, which may be useful in some applications, but also complicate the design analysis and increase the cost of manufacture. Finally, while particular materials have been discussed above for the diaphragms, other materials having the indicated characteristics could also be utilized. Suitable materials might include for example certain aluminum or other metal honey comb structures, plastic honey comb structures, expanded materials, foamed materials and corrugated paper materials. Thus, while the invention has been particularly shown and described above with reference to an illustrative embodiment, the foregoing and other changes in form or detail may be made therein by one skilled in the art while still remaining within the spirit and scope of the invention which is to be defined only by the appended claims.

What is claimed is:

1. A planar type loudspeaker for operation in a selected frequency band, said loudspeaker including:

at least two separate, substantially flat, substantially coplanar, diaphragms, and a common drive mechanism directly controlling driving of both said diaphragms, said diaphragms each being of a material and being dimensioned so that each has only a limited number of natural modes of vibration in said selected frequency band, corresponding natural modes for said diaphragms being close enough to achieve beneficial mechanical coupling and acoustic interference so as to provide a generally uniform acoustic pressure response over said selected frequency band.

2. A loudspeaker as claimed in claim 1 wherein said diaphragms are coupled only through said drive mechanism.

3. A loudspeaker as claimed in claim 1 wherein each of said diaphragms has only two natural modes of vibration in said selected frequency band.

4. A loudspeaker as claimed in claim 1 wherein there are two coaxial, substantially circular diaphragms, an inner diaphragm and an outer diaphragm, said drive mechanism being connected to both diaphragms.

5. A loudspeaker as claimed in claim 4 wherein each of said diaphragms has only two natural modes of vibration in said selected frequency band, said inner diaphragm having first and second natural modes $F1_{in}$ and $F2_{in}$ respectively, said outer diaphragm having first and second natural modes $F1_{out}$ and $F2_{out}$ respectively, wherein $F1_{out}/F1_{in}\approx 0.4$ to 2.1 wherein $F2_{out}/F2_{in}\approx 0.5$ to 2.0.

6. A loudspeaker as claimed in claim 4 including extra material applied to at least one of said diaphragms to alter at least one of said natural modes in a predetermined way.

7. A loudspeaker as claimed in claim 6 wherein said extra material is a piece of material having good damping properties attached at least near the center of said inner diaphragm.

8. A loudspeaker as claimed in claim 4 wherein said outer diaphragm is attached to a frame of the loudspeaker through a compliant surround.

9. A loudspeaker as claimed in claim 1 including extra material applied to at least one of said diaphragms to alter at least one of said natural modes in a predetermined way.

10. A loudspeaker as claimed in claim 9 wherein said extra material has good damping properties and also provides selective damping.

11. A loudspeaker as claimed in claim 1 including an outer frame, at least one of said diaphragms being adjacent to said frame, and wherein each said at least one adjacent diaphragm is attached to said frame through a compliant surround.

* * * * *